US006177620B1

(12) United States Patent
Alulyan

(10) Patent No.: US 6,177,620 B1
(45) Date of Patent: Jan. 23, 2001

(54) SNARE REMOVING DEVICE FOR A DRUM

(76) Inventor: Moris Alulyan, 1206 N. Kingsley Dr. #1, Los Angeles, CA (US) 90029

( * ) Notice: Under 35 U.S.C. 154(b), the term of this patent shall be extended for 0 days.

(21) Appl. No.: 09/377,111

(22) Filed: Aug. 19, 1999

(51) Int. Cl.[7] ..... G10D 13/02

(52) U.S. Cl. ..... 84/415; 84/411 R; 84/417; 84/421

(58) Field of Search ..... 84/415, 417, 421, 84/453, 458, 411 R

(56) References Cited

U.S. PATENT DOCUMENTS 1,011,533 * 12/1911 Wanamaker ..... 84/415
1,458,905 * 6/1923 Leady ..... 84/415
1,892,223 * 12/1932 Sonsone et al. ..... 84/419
2,834,244 * 5/1958 Willits ..... 84/411 R

* cited by examiner

*Primary Examiner*—David Martin
*Assistant Examiner*—Shih-yung Hsieh
(74) *Attorney, Agent, or Firm*—Goldstein & Canino

(57) ABSTRACT

A snare removing device for a drum including a drum having an upper drumming surface, a lower surface, and a cylindrical side wall therebetween. The lower surface has a snare removably coupled thereto. An adjustable tripod is secured to the lower surface of the drum. A snare removing portion is provided that is comprised of a telescopic vertical arm having a pivoting upper portion pivotally coupled with the snare whereby pivoting of the pivoting upper portion will remove the snare from the lower surface of the drum.

4 Claims, 2 Drawing Sheets

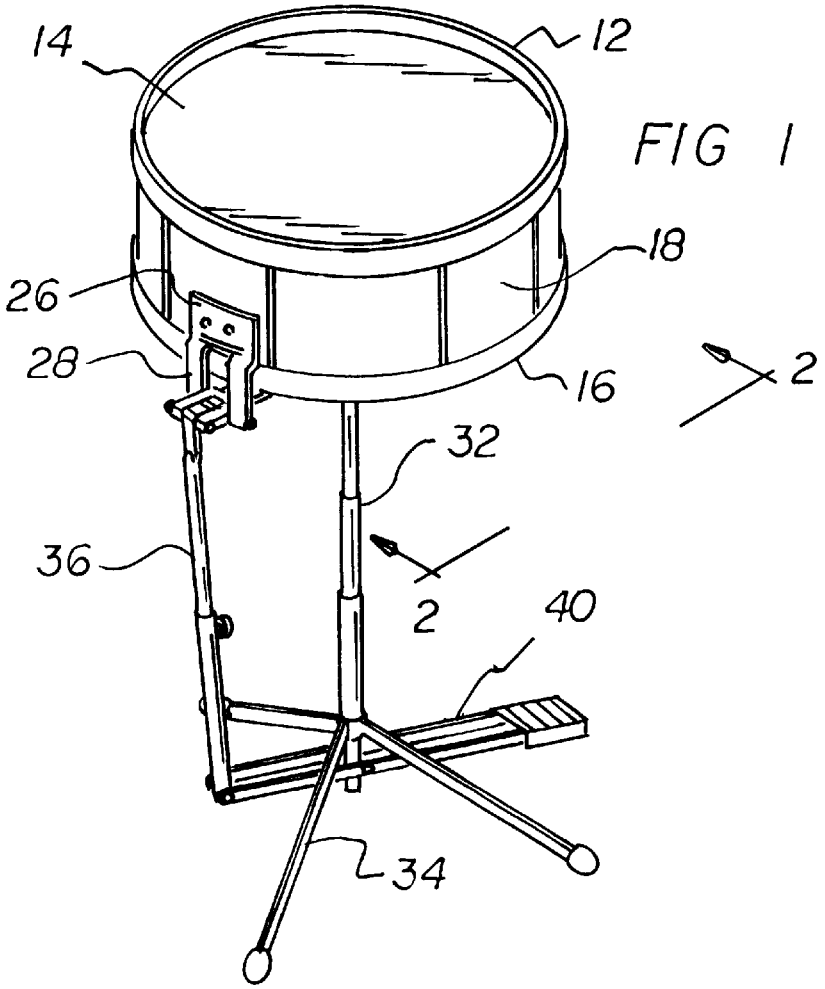
FIG 1
FIG 2
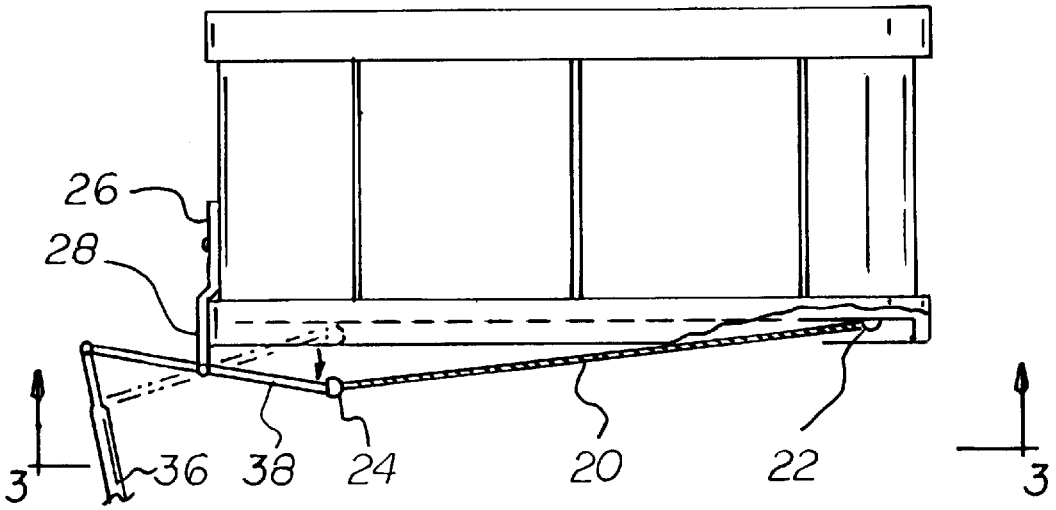

SNARE REMOVING DEVICE FOR A DRUM

BACKGROUND OF THE INVENTION

The present invention relates to a snare removing device for a drum and more particularly pertains to altering a sound created by a drum by being able to remove the snare therefrom.

The use of drum sets is known in the prior art. More specifically, drum sets heretofore devised and utilized for the purpose of creating music are known to consist basically of familiar, expected and obvious structural configurations, notwithstanding the myriad of designs encompassed by the crowded prior art which have been developed for the fulfillment of countless objectives and requirements.

While these devices fulfill their respective, particular objective and requirements, these patents do not describe a snare removing device for a drum for altering a sound created by a drum by being able to remove the snare therefrom.

In this respect, the snare removing device for a drum according to the present invention substantially departs from the conventional concepts and designs of the prior art, and in doing so provides an apparatus primarily developed for the purpose of altering a sound created by a drum by being able to remove the snare therefrom.

Therefore, it can be appreciated that there exists a continuing need for new and improved snare removing device for a drum which can be used for altering a sound created by a drum by being able to remove the snare therefrom. In this regard, the present invention substantially fulfills this need.

SUMMARY OF THE INVENTION

In the view of the foregoing disadvantages inherent in the known types of drum sets now present in the prior art, the present invention provides an improved snare removing device for a drum. As such, the general purpose of the present invention, which will be described subsequently in greater detail, is to provide a new and improved snare removing device for a drum and method which has all the advantages of the prior art and none of the disadvantages.

To attain this, the present invention essentially comprises a drum having an upper drumming surface, a lower surface, and a cylindrical side wall therebetween. The lower surface has a snare removably coupled thereto. The snare has a first end fixedly secured to the drum and a second end removably coupled with the drum. The cylindrical side wall has a mounting bracket secured thereto adjacent to the second end of the snare. The mounting bracket has a bifurcated lower end extending downwardly below the lower surface. An adjustable tripod is secured to the lower surface of the drum. The adjustable tripod has a telescoping upper portion and a multi-legged base portion. A snare removing portion is provided that is comprised of a telescopic vertical arm having a pivoting upper portion pivotally coupled with the bifurcated lower end of the mounting bracket at a central point thereof. An inner end of the pivoting upper portion is secured to the second end of the snare whereby pivoting of the pivoting upper portion will remove the second end of the snare from the lower surface of the drum. A lower end of the vertical arm has a foot pedal secured thereto. An intermediate portion of the foot pedal is pivotally coupled with the multi-legged base portion of the adjustable tripod whereby stepping on a free end of the foot pedal will cause the vertical arm to rise thereby removing the second end of the snare from the drum.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved snare removing device for a drum which has all the advantages of the prior art drum sets and none of the disadvantages.

It is another object of the present invention to provide a new and improved snare removing device for a drum which may be easily and efficiently manufactured and marketed.

It is a further object of the present invention to provide a new and improved snare removing device for a drum which is of durable and reliable construction.

An even further object of the present invention is to provide a new and improved snare removing device for a drum which is susceptible of a low cost of manufacture with regard to both materials and labor, and which accordingly is then susceptible of low prices of sale to the consuming public, thereby making such a snare removing device for a drum economically available to the buying public.

Even still another object of the present invention is to provide a new and improved snare removing device for a drum for altering a sound created by a drum by being able to remove the snare therefrom.

Lastly, it is an object of the present invention to provide a new and improved snare removing device for a drum including a drum having an upper drumming surface, a lower surface, and a cylindrical side wall therebetween. The lower surface has a snare removably coupled thereto. An adjustable tripod is secured to the lower surface of the drum. A snare removing portion is provided that is comprised of a telescopic vertical arm having a pivoting upper portion pivotally coupled with the snare whereby pivoting of the pivoting upper portion will remove the snare from the lower surface of the drum.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective view of the preferred embodiment of the snare removing device for a drum constructed in accordance with the principles of the present invention.

FIG. 2 is a side view of the present invention as taken along line 2—2 of FIG. 1.

The same reference numerals refer to the same parts through the various figures.

DESCRIPTION OF THE PREFERRED EMBODIMENT

Figure 3:
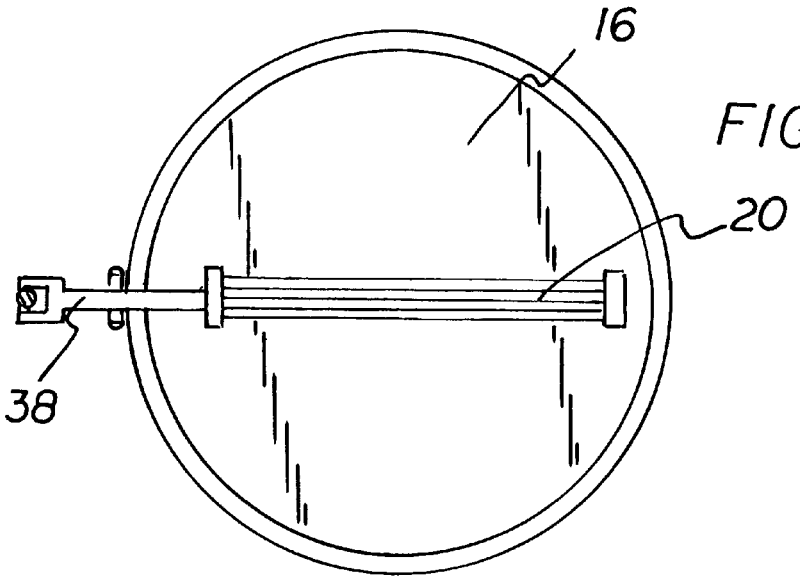
FIG. 3 is a bottom view of the present invention as taken along line 3—3 of FIG. 2.
Figure 4:
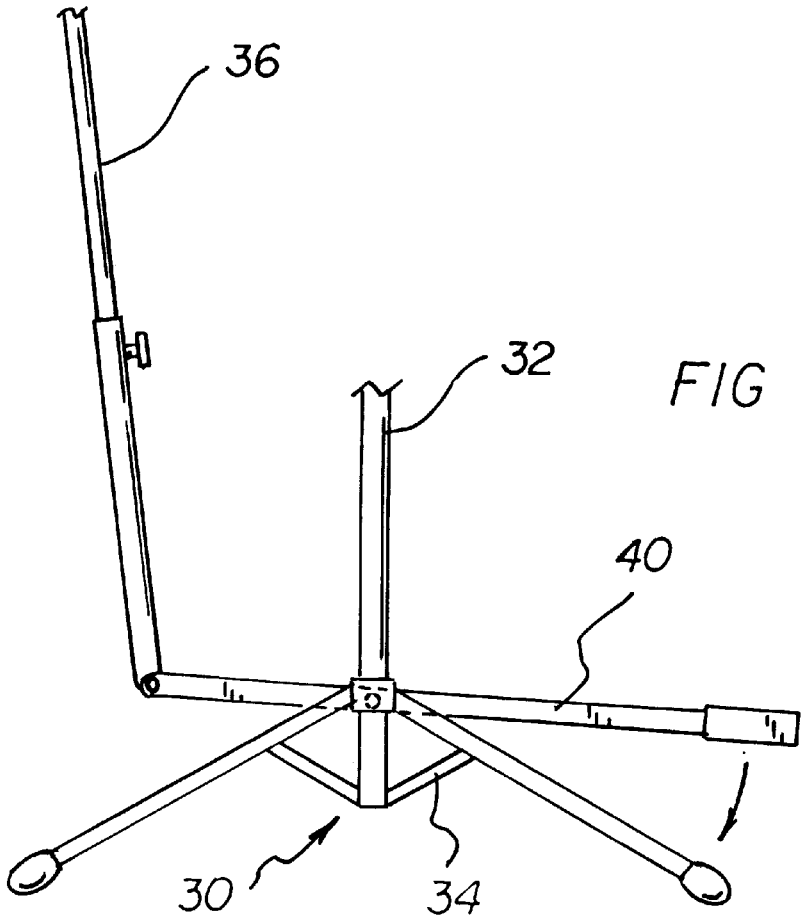
FIG. 4 is a side elevation view of the present invention.

With reference now to the drawings, and in particular, to FIGS. 1 through 4 thereof, the preferred embodiment of the new and improved snare removing device for a drum embodying the principles and concepts of the present invention and generally designated by the reference number 10 will be described.

Specifically, it will be noted in the various Figures that the device relates to a snare removing device for a drum for altering a sound created by a drum by being able to remove the snare therefrom. In its broadest context, the device consists of a drum, an adjustable tripod, and a snare removing portion. Such components are individually configured and correlated with respect to each other so as to attain the desired objective.

The drum 12 has an upper drumming surface 14, a lower surface 16, and a cylindrical side wall 18 therebetween. The lower surface 16 has a snare 20 removably coupled thereto. The snare 20 has a first end 22 fixedly secured to the drum 12 and a second end 24 removably coupled with the drum 12. The cylindrical side wall 18 has a mounting bracket 26 secured thereto adjacent to the second end 24 of the snare 20. The mounting bracket 26 has a bifurcated lower end 28 extending downwardly below the lower surface 16.

The adjustable tripod 30 is secured to the lower surface 16 of the drum 12. The adjustable tripod 30 has a telescoping upper portion 32 and a multi-legged base portion 34.

The snare removing portion is comprised of a telescopic vertical arm 36 having a pivoting upper portion 38 pivotally coupled with the bifurcated lower end 28 of the mounting bracket 26 at a central point thereof. An inner end of the pivoting upper portion 38 is secured to the second end 24 of the snare 20 whereby pivoting of the pivoting upper portion 38 will remove the second end 24 of the snare 22 from the lower surface 16 of the drum 12. A lower end of the vertical arm 36 has a foot pedal 40 secured thereto. An intermediate portion of the foot pedal 40 is pivotally coupled with the multi-legged base portion 34 of the adjustable tripod 30 whereby stepping on a free end of the foot pedal 40 will cause the vertical arm 36 to rise thereby removing the second end 24 of the snare 20 from the drum 12.

In use, the present invention allow the snare 20 to be I5 removed from the drum 12 to create an alternate sound that would normally only be achieved by having an additional drum. By releasing the foot pedal 40, the snare 20 will be positioned in it's original position against the lower surface 16 of the drum 12 to return to the original sound produced by banging on the drum 12.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A snare removing device for a drum for altering a sound created by a drum by being able to remove the snare therefrom comprising, in combination:

a drum having an upper drumming surface, a lower surface, and a cylindrical side wall therebetween, the lower surface having a snare removably coupled thereto, the snare having a first end fixedly secured to the drum and a second end removably coupled with the drum, the cylindrical side wall having a mounting bracket secured thereto adjacent to the second end of the snare, the mounting bracket having a bifurcated lower end extending downwardly below the lower surface;

an adjustable tripod secured to the lower surface of the drum, the adjustable tripod having a telescoping upper portion and a multi-legged base portion;

a snare removing portion comprised of a telescopic vertical arm having a pivoting upper portion pivotally coupled with the bifurcated lower end of the mounting bracket at a central point thereof, an inner end of the pivoting upper portion being secured to the second end of the snare whereby pivoting of the pivoting upper portion will remove the second end of the snare from the lower surface of the drum, a lower end of the vertical arm having a foot pedal secured thereto, an intermediate portion of the foot pedal being pivotally coupled with the multi-legged base portion of the adjustable tripod whereby stepping on a free end of the food pedal will cause the vertical arm to rise thereby removing the second end of the snare from the drum.

2. A snare removing device for a drum for altering a sound created by a drum by being able to remove the snare therefrom comprising, in combination:

a drum having an upper drumming surface, a lower surface, and a cylindrical side wall therebetween, the lower surface having a snare removably coupled thereto;

said cylindrical side wall having a mounting bracket secured thereto adjacent to the second end of the snare, the mounting bracket has a bifurcated lower end extending downwardly below the lower surface for coupling with the vertical portion of the snare removing device;

an adjustable tripod secured to the lower surface of the drum;

a snare removing portion comprised of a telescopic vertical arm having a pivoting upper portion pivotally coupled with the snare whereby pivoting of the pivoting upper portion will remove the snare from the lower surface of the drum; and whereby the snare has a first end fixedly secured to the drum and a second end removably coupled with the drum.

3. The snare removing device for a drum as set forth in claim 2 wherein the pivoting upper portion is pivotally coupled with the bifurcated lower end of the mounting bracket at a central point thereof, an inner end of the pivoting upper portion being secured to the second end of the snare whereby pivoting of the pivoting upper portion will remove the second end of the snare from the lower surface of the drum.

4. The snare removing device for a drum as set forth in claim 3 wherein a lower end of the vertical arm has a foot pedal secured thereto, an intermediate portion of the foot pedal being pivotally coupled with the adjustable tripod whereby stepping on a free end of the food pedal will cause the vertical arm to rise thereby removing the second end of the snare from the drum.

* * * * *